US006848741B2

(12) United States Patent
Ford et al.

(10) Patent No.: US 6,848,741 B2
(45) Date of Patent: Feb. 1, 2005

(54) BOWLING TABLE WITH MULTIPLE SEATING ARRANGEMENTS

(75) Inventors: Gary J. Ford, Chesterfield, VA (US); William Bredlow, Baltimore, MD (US); Brian Williamson, Richmond, VA (US)

(73) Assignee: AMF Bowling Worldwide, Inc., Mechanicsville, VA (US)

( * ) Notice: Subject to any disclaimer, the term of this patent is extended or adjusted under 35 U.S.C. 154(b) by 0 days.

(21) Appl. No.: 10/438,874

(22) Filed: May 16, 2003

(65) Prior Publication Data

US 2003/0234564 A1 Dec. 25, 2003

Related U.S. Application Data

(63) Continuation of application No. 29/162,606, filed on Jun. 17, 2002, now Pat. No. Des. 478,427.

(51) Int. Cl.[7] ..... A47B 83/02

(52) U.S. Cl. ..... 297/157.1; 297/158.3; 297/174 R

(58) Field of Search ..... 297/158.3, 158.4, 297/157.1, 174 R; D6/338, 336, 337

(56) References Cited

U.S. PATENT DOCUMENTS

| | | | | | |
|---|---|---|---|---|---|
| D173,910 | S | | 1/1955 | Neuendorf | |
| D196,121 | S | | 8/1963 | Soszynski | |
| 3,120,405 | A | * | 2/1964 | Soszynski | 297/158.3 X |
| D206,998 | S | | 2/1967 | Benjamin | |
| 3,477,760 | A | * | 11/1969 | Bue et al. | 297/158.3 X |
| D222,806 | S | | 1/1972 | Wise | |
| D272,302 | S | | 1/1984 | Connelly | |
| D339,487 | S | | 9/1993 | Rizzi | |
| D367,772 | S | | 3/1996 | Stirling et al. | |
| D377,124 | S | | 1/1997 | Stirling et al. | |
| D379,874 | S | | 6/1997 | Stirling et al. | |
| D409,008 | S | | 5/1999 | Lunn | |
| D412,415 | S | | 8/1999 | Adler et al. | |
| D427,802 | S | | 7/2000 | Adler et al. | |
| D456,645 | S | | 5/2002 | Iverson | |

* cited by examiner

*Primary Examiner*—Anthony Barfield
(74) *Attorney, Agent, or Firm*—McGuireWoods LLP

(57) ABSTRACT

A furniture unit that includes a substantially triangular table and a first and second plurality of seats fixedly attached along two sides of the table. A directional view of the third side of the table is unobstructed as viewed from any of the first and second plurality of seats. A support structure is provided that maintains the table and the first and second plurality of seats at a certain distance and provides for unobstructed leg-area. A third set of seats may be provided along each of the three sides of the substantially triangular table and may be interconnected by a support structure that provides a substantially unobstructed ingress and egress to each seat.

30 Claims, 6 Drawing Sheets

BOWLING TABLE WITH MULTIPLE SEATING ARRANGEMENTS

CROSS-REFERENCE TO RELATED APPLICATIONS

This application is a continuation application of U.S. Design Application No. 29/162,606, filed Jun. 17, 2002, now issued as U.S. Pat. No. D,478,427, which is incorporated by reference, herein, in its entirety.

BACKGROUND OF THE INVENTION

1. Field of the Invention

The present invention generally relates to a furniture unit, and more specifically, a table with sets of seats attached along the sides of thereof arranged for unimpeded viewing.

2. Background Description

Various types of tables with seating arrangements are known. However, a table with attached seats arranged to provide a socially friendly configuration with consideration for convenience of entry and exit are of limited availability. In certain settings, such as for example, a bowling alley setting or the like, a table can contribute to the motif and ambiance and provide functional convenience for the clientele or user. Whether the table is used in a working session/meeting type of situation (e.g., a school or the like) or in a social setting (e.g., a bowling alley) the table should be easy and convenient to access while entering, remaining in, or exiting a seat. Table and seat configurations and support structures should be oriented to minimize undue interference when entering or exiting a seat, and the seat should be conveniently oriented in relation to the table. The orientation of the seats should also provide optimum-viewing directivity in applications requiring directed views.

Currently, there are several known types of table and chair arrangements used in bowling alley settings. But none of these configurations are known to provide ease of viewing, regardless of the seating position of the user, easy ingress and egress as well as other advantages. By way of example, it is known to use rectangular-type tables with seats positioned on both sides of the table. In this type of configuration, the users sit at the table, facing one another; however, there is no clear view of the bowling lanes, thus provided an impediment to the viewing of the game, itself. This makes an uncomfortable setting. In other types of arrangements, it is known to place seats on all sides of the table, also contributing to the hindrance of viewing and enjoyment by the participants. Another known type of seating arrangement is the "scoring table" configuration. This same type of configuration can be used in other applications throughout the bowling alley setting. In this configuration, only two seats are provided adjacent to one another. This, of course, is not conducive for conversation and is limited to the seating of two people.

The present invention overcomes the above problems.

SUMMARY OF THE INVENTION

In an aspect of the present invention, a furniture unit is provided comprising a substantially triangular table with a first and second plurality of seats positioned along a first and second side, respectively. The third side of the substantially triangular table is devoid of fixedly attached seats such that the position of the first and second plurality of seats provides an unobstructed view towards the third side of the substantially triangular table.

In another aspect of the present invention, a furniture unit is provided comprising a substantially triangular table with a first and second plurality of seats positioned along a first and second side, respectively. The position of the first and second plurality of seats provides an unobstructed view towards a view of the third side of the table. A support structure provides support to the substantially triangular table and each seat of the first and second plurality of seats. The support structure maintains and supports the table and each seat at a predetermined distance.

In an aspect of the present invention, a furniture unit is provided consisting essentially of a substantially triangular table and a first and second plurality of seats positioned along a first and second side of the substantially triangular table. A support structure supports the substantially triangular table and each seat of the first and second plurality of seats. The support structure includes horizontal support members and vertical support members. Each seat of the first and second plurality of seats are attached to respective ones of the vertical support members and at least one of the vertical support members is attached to an underside of the substantially triangular table. The horizontal support members are fixedly attached between the at least one of the vertical support member and the respective ones of the vertical support members. A third side of the substantially triangular table is devoid of fixedly attached seats such that the position of the first and second plurality of seats provides an unobstructed view towards the third side of the substantially triangular table.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A DETAILED EMBODIMENT OF THE INVENTION

Figure 1:
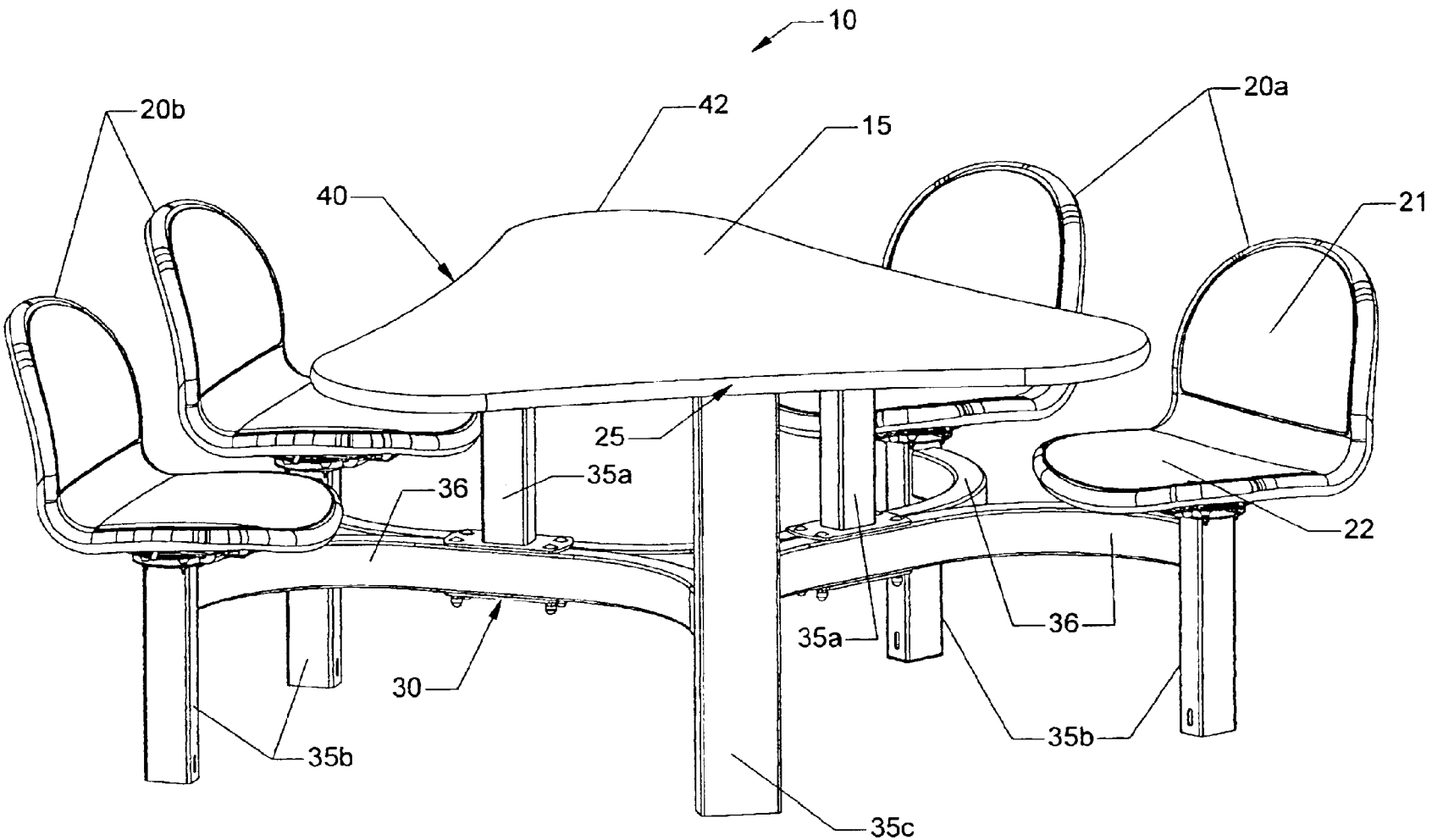
FIG. 1 is a perspective view of an embodiment of the present invention.

FIG. 1 is a perspective view of an embodiment of the present invention, generally denoted as reference numeral 10. In this configuration, the present invention includes a substantially triangular table 15 with a first set of seats 20*a* fixed along a first side of the substantially triangular table 15 and a second set of seats 20*b* fixed along a second side of the substantially triangular table 15. The substantially triangular table may be a cam-shaped having acutely angled sides with respect to a third side such that the seats placed on the acutely angled sides allow for an unobstructed view towards the third side in accordance with the present invention. The seats 20*a* and 20*b* may be more than two seats on each side of the table 15, depending on the particular use, the space requirements and the like. In this embodiment, a third side 25 of the substantially triangular table 15 is devoid or free from a third set of seats. In this manner, the seats 20*a* and 20*b* provide the participants an unobstructed view towards a third side 25 of the substantially triangular table 15 when any or all of the seats are occupied. This arrangement allows for both a socially friendly configuration and permits unobstructed viewing towards the third side 25. This type of arrangement would be suitable for various types of settings, such as for example, bowling alleys or the like.

Figure 2:
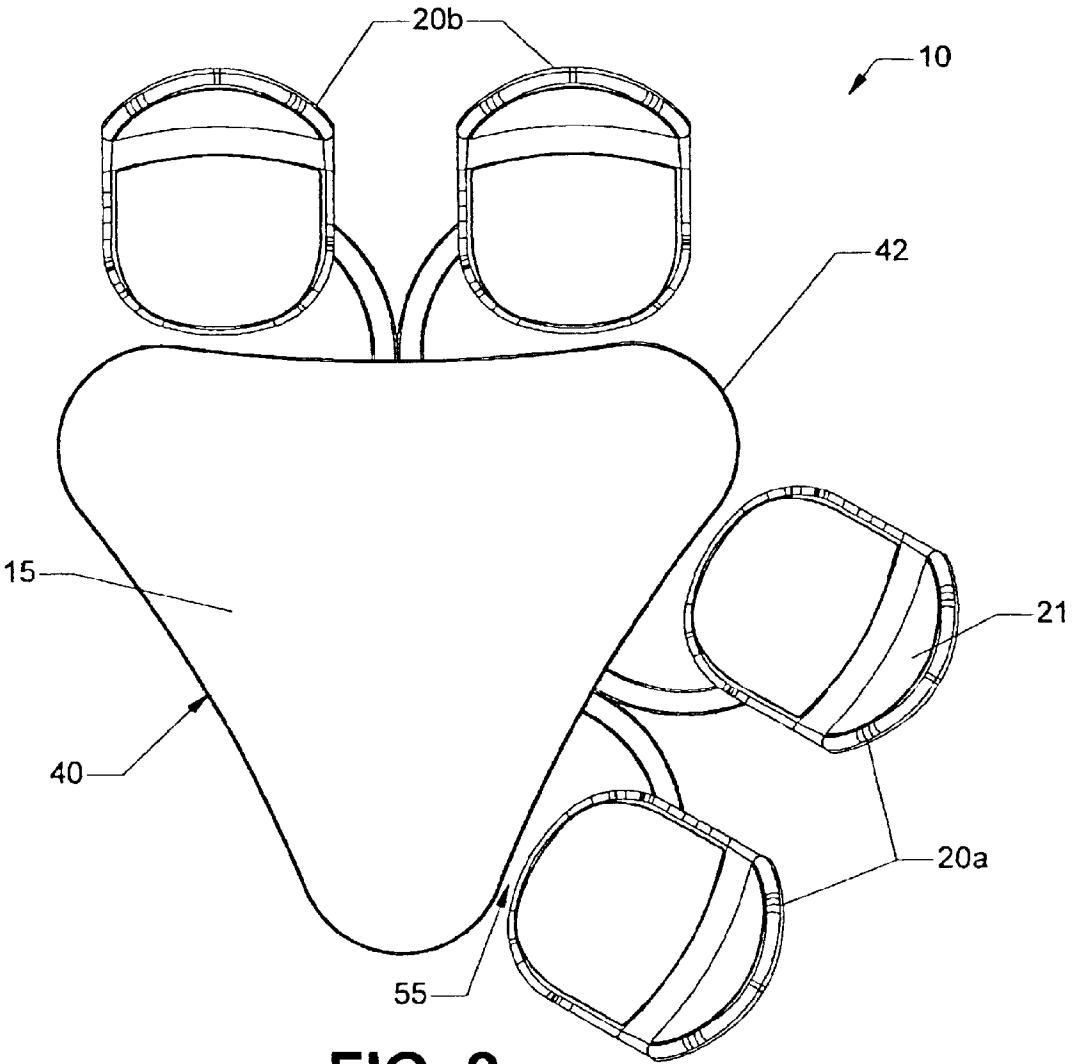
FIG. 2 is a top view of the embodiment of the present invention, according to FIG. 1.
Figure 3:
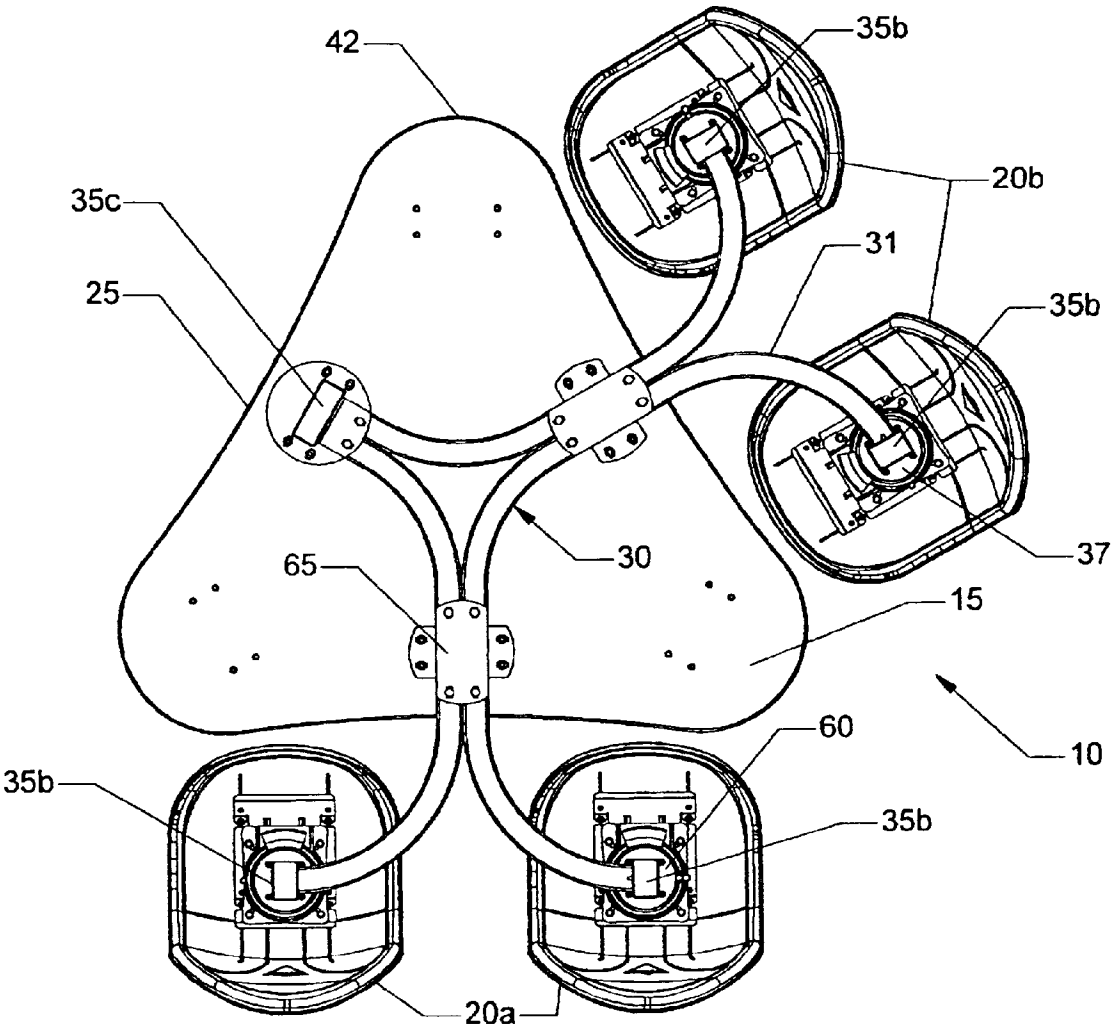
FIG. 3 is a bottom view of the embodiment of the present invention, according to FIG. 1.

Still referring to FIGS. 1–3, the sides of the substantially triangular table 15 may include substantially concave edges 40. The substantially triangular table 15 may also be a substantially equilateral triangular table, although, other triangular configurations are also contemplated by the present invention. The corners 42 of the substantially triangular table 15 may be rounded to prevent the "snagging" of clothing and the like. A support structure, generally denoted by reference numeral 30, is further provided on an underside of the table 15. The support structure provides support to the substantially triangular table 15 and to each seat of the first and second set of seats 20*a* and 20*b*. The support structure 30 includes horizontal support members 36 and vertical support members 35*a*–35*c*.

In the configuration of FIGS. 1–3, the seats 20*a* and 20*b* are attached to a respective one of the vertical support members 35*b*. The seats may be attached via any known swivel mechanism to allow for easy ingress and egress. The swivel 37 also provides for a return of the seat to an original position, thus having the seat remain in an orderly fashion. At least one vertical support member 35*a* or 35*c* is also attached to the substantially triangular table 15. In an embodiment, at least one of the vertical support members 35*a* and 35*c* provides support of the substantially triangular table 15 when attached to the underside of the substantially triangular table 15. At least one of the vertical support structures is supported on a supporting surface such as a floor. In the embodiment of the present invention, the vertical support member 35*a* is attached between an underside of the substantially triangular table 15 and to the horizontal support members 36. The vertical support member 35*a* may be fastened by an appropriate manner, such as for example, a set of bolts, welds or the like. The horizontal support members 36 maintain the substantially triangular table 15 and each of the first and second set of seats 20*a* and 20*b* at a predetermined distance from a respective supporting structure 35*a* or 35*c* and hence the table, itself.

Referring to FIGS. 1 and 3, the horizontal support members 36 are fixedly attached to the vertical support members 35*a* and to each first and second set of seats 20*a* and 20*b*. Similarly, the horizontal support members 36 may also be attached to the vertical support members 35*c*. The horizontal support members 36 also fixedly attach to the vertical support members 35*b* of the first and second set of seats at a substantially fixed, i.e., predetermined, distance from the substantially triangular table 15. This creates a leg-area between the substantially triangular table 15 and each seat of the first and second set of seats 20*a* and 20*b*, so that the leg-area is substantially unobstructed by any part of the present invention. This arrangement maintains the relationship between the substantially triangular table 15 and the first and second set of seats, 20*a* and 20*b*, and also provides for unobstructed ingress and egress, thereto and therefrom, respectively, denoted by reference numeral 55 (FIG. 2).

The first and second set of seats, 20*a* and 20*b* may also include contoured backs 21 and contoured seat platforms 22. These contours provide for a certain level of comfort to any occupant. As shown in FIG. 3, each seat of the first and second set of seats 20*a* and 20*b* are attached to a corresponding vertical support member 35*b* by an attachment mechanism 60, located under each of the respective seats. This arrangement maintains each the first and second set of seats 20*a* and 20*b* at a predetermined height. The horizontal support members 36 may also include curved shaped sections, shown as reference numeral 31. The curved shaped sections 31 may be joined together by a connecting bracket 65. The ends of the curved sections 31 attach to the vertical support members 35*b* or 35*c*, as appropriate. Vertical support members 35*a* may also be supported as necessary by the horizontal support member 36, which may include curved sections 31.

Figure 4:
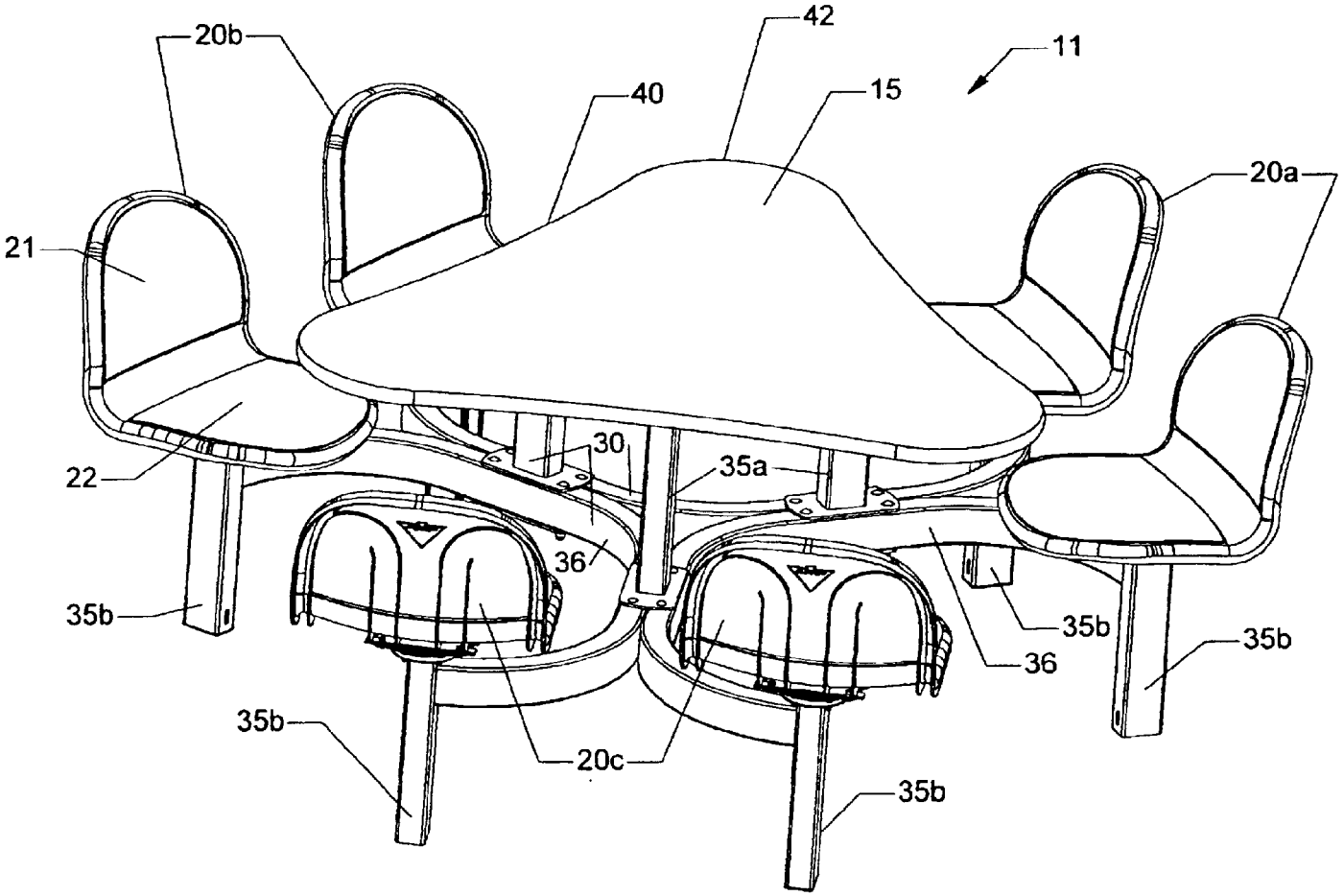
FIG. 4 is a perspective view of an embodiment of the present invention.
Figure 5:
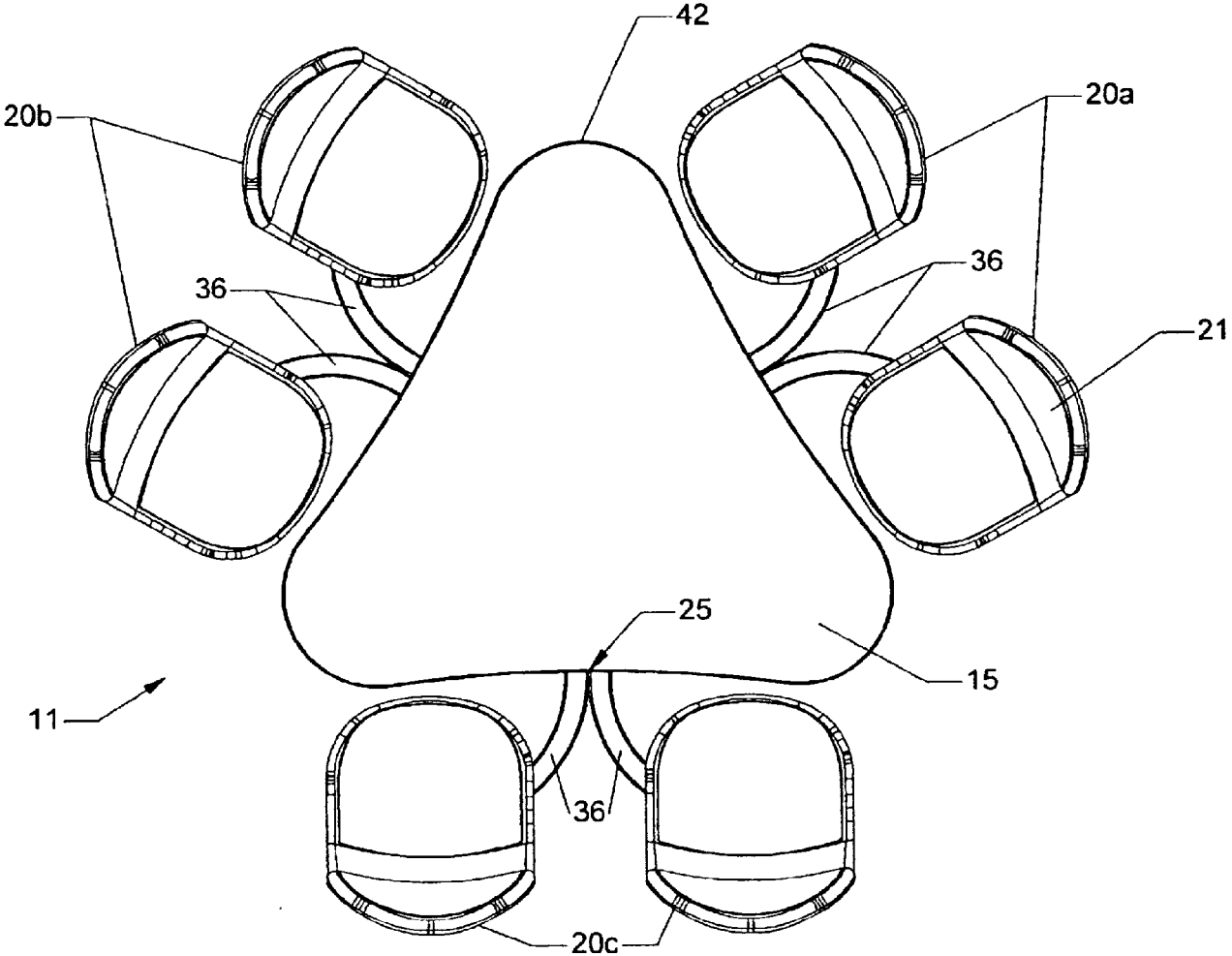
FIG. 5 is a top view of the embodiment of the present invention, according to FIG. 4.
Figure 6:
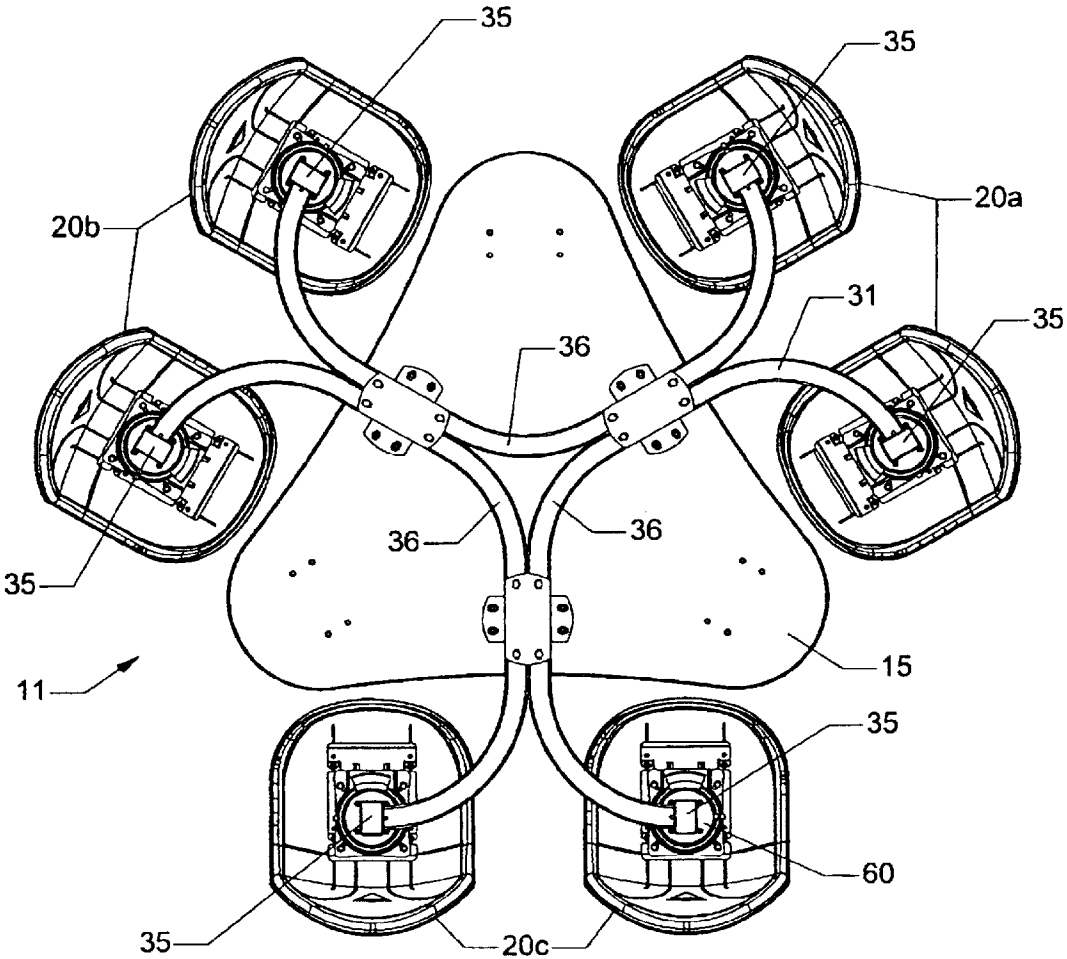
FIG. 6 is a bottom view of the embodiment of the present invention, according to FIG. 4.

FIG. 4 is a perspective view of an embodiment of the present invention with a first, second and third set of seats on three sides, respectively, of a substantially triangular table. FIG. 5 and FIG. 6 are a top view and a bottom view, respectively, of the embodiment of FIG. 4. The features of this embodiment are similar to the features discussed previously. In this embodiment, however, a third set of seats 20*c* are positioned along the third side 25 of the substantially triangular table 15. The supporting structure 30 is similarly arranged as previously described, including horizontal support members 36, that may include curved sections 31. The vertical support members 35*a* and 35*b* are substantially the same as previously discussed, but typically includes one additional vertical support member 35*a* to support the substantially triangular table 15. In this embodiment, the vertical support member 35*c* is typically not employed. The horizontal support members 36 is now generally symmetrical in three directions in support of the first, second, and third set of seats positioned along the three sides of the substantially triangular table 15. The horizontal support members 36 maintain a predetermined distance between the substantially triangular table and each seat of the first, second and third sets of seats 20*a*, 20*b* and 20*c*.

While the invention has been described in terms of preferred embodiments, those skilled in the art will recognize that the invention can be practiced with modifications and in the spirit and scope of the appended claims.

Having thus described our invention, what we claim as new and desire by Letters Patent is as follows:

1. A furniture unit, comprising:

a substantially triangular table having a first side, a second side and a third side;

a first plurality of seats fixed to the substantially triangular table along the first side thereof;

a second plurality of seats fixed to the substantially triangular table along the second side thereof; and at least one vertical support member adapted to be supported by a supporting surface extending from an underside of the substantially triangular table to the supporting surface, wherein the third side of the substantially triangular table is devoid of fixedly attached seats such that the position of the first and second plurality of seats provides an unobstructed view towards the third side of the substantially triangular table.

2. The furniture unit of claim 1, further comprising a support structure to support the substantially triangular table and each seat of the first and second plurality of seats.

3. The furniture unit of claim 2, wherein:

the support structure includes a horizontal support member and the at least one vertical support member includes a plurality of vertical support members, and the each seat of the first and second plurality of seats being attached to respective ones of the vertical support members.

4. The furniture unit of claim 3, wherein each seat of the first and second plurality of seats is attached to the horizontal support structure for spacing the each seat at a distance from the substantially triangular table.

5. The furniture unit of claim 3, wherein the horizontal support member is fixedly attached to at least one of the vertical support members between the substantially triangular table and the first and second plurality of seats.

6. The furniture unit of claim 3, wherein the plurality of first and second seats are attached to the horizontal support member so that a leg-area between the substantially triangular table and each seat of the plurality of first and second seats is substantially unobstructed.

7. The furniture unit of claim 1, wherein the substantially triangular table is a cam shaped.

8. The furniture unit of claim 7, wherein the cam shaped table has rounded corners.

9. The furniture unit of claim 1, wherein the first and second plurality of seats are swivel mounted to a frame connected to the substantially triangular table at a fixed distance.

10. A furniture unit with attached seats, comprising:

a substantially triangular table;

a first set of seats positioned along a first side of the substantially triangular table;

a second set of seats positioned along a second side of the substantially triangular table; and a support structure supporting the substantially triangular table and each seat of the first and second set of seats, the support structure further connecting the substantially triangular table to each seat of the first and second set of seats at a fixed distance from the substantially triangular table,wherein the support structure includes:

a horizontal frame structure connecting to the first and second set of seats, and a vertical frame member extending from a bottom surface of the substantially triangular table to a supporting surface.

11. The furniture unit of claim 10, wherein the substantially triangular table is a substantially equilateral triangular table.

12. The furniture unit of claim 10, wherein the substantial triangular table has rounded corners.

13. The furniture unit of claim 10, wherein each side of the substantial triangular table includes substantially concave portions.

14. The furniture unit of claim 10, wherein each seat of the first and second sets of seats is substantially equidistant from the substantially triangular table.

15. The furniture unit of claim 10, wherein the third side of the substantially triangular table is devoid of or free from seats in order to provide an unobstructed view from the first set and second set of seats towards the third side.

16. The furniture unit of claim 10, wherein the support structure further includes vertical supports for maintaining the substantially triangular table and the first and second set of seats at a predetermined distance from the substantially triangular table.

17. The furniture unit of claim 10, wherein each seat of the first and second set of seats includes a contoured back and a contoured seat platform.

18. The furniture unit of claim 10, wherein the support structure includes horizontal support members and vertical support members, wherein:

each seat of the first and second set of seats are attached to respective ones of the vertical support members, at least one of the vertical support members is the vertical frame member attached to the underside of the substantially triangular table, and the horizontal support members are fixedly attached to the at least one of the vertical support member and the respective ones of the vertical support members attached to the each seat.

19. The furniture unit of claim 10, further comprising a third set of seats positioned along the third side of the substantially triangular table.

20. The furniture unit of claim 10, wherein the substantially triangular table is a cam shape.

21. The furniture unit of claim 10, wherein the first and second set of seats are swivel mounted to the support structure at a fixed distance from the substantially triangular table.

22. The furniture unit of claim 10, wherein the horizontal frame structure is connected to the vertical frame member.

23. The furniture unit of claim 10, wherein the vertical frame member includes vertical frame structures extending from the bottom surface of the substantially triangular table to portions of the horizontal frame structure.

24. The furniture unit of claim 23, wherein the vertical frame member and the structure support the substantially triangular table.

25. The furniture unit of claim 10, wherein the horizontal frame structure includes a plurality of frame members directly connecting at least one seat of the first set of seats and one seat of the second set of seats.

26. The furniture unit of claim 10, wherein the horizontal frame structure connects individually to each seat of the first and second set of seats.

27. A furniture unit consisting essentially of:

a substantially triangular table;

a first pair of seats positioned along a first side of the substantially triangular table;

a second pair of seats positioned along a second side of the substantially triangular table;

a support structure supporting the substantially triangular table and each seat of the first and second pair of seats, wherein the support structure includes:

horizontal support members, and vertical support members, wherein each seat of the first and second pair of seats is attached to respective ones of the vertical support members, at least one of the vertical support members is attached to an underside of the substantially triangular table, and the horizontal support members are fixedly attached between the at least one of the vertical support member and the respective ones of the vertical support members, wherein a third side of the substantially triangular table is devoid of fixedly attached seats such that the position of the first and second pair of seats provides an unobstructed view towards the third side of the substantially triangular table.

28. The furniture unit of claim 27, wherein the substantially triangular table is a substantially equilateral triangular table and has rounded corners.

29. A furniture unit with attached seats, comprising:

a substantially triangular table;

a first set of seats positioned along a first side of the substantially triangular table;

a second set of seats positioned along second side of the substantially triangular table; and a support structure including:

a horizontal support structure extending to each seat of the first and second set of seats and connecting the each seat at a fixed distance from the substantially triangular table; and a vertical support structure extending from an underside of the substantially triangular table to at least one horizontal frame member of the horizontal frame structure.

30. A furniture unit, comprising:

a substantially triangular table having a first side, a second side and a third side;

a first plurality of seats fixed to the substantially triangular table along the first side thereof;

a second plurality of seats fixed to the substantially triangular table along the second side thereof;

a horizontal frame structure connecting between the first and second set of seats, and at least one vertical support member extending from an underside of the substantially triangular table to a supporting surface and connecting to the horizontal frame structure.

* * * * *